US008894407B2

(12) United States Patent
Stoia et al.

(10) Patent No.: US 8,894,407 B2
(45) Date of Patent: Nov. 25, 2014

(54) COMBUSTOR AND METHOD FOR SUPPLYING FUEL TO A COMBUSTOR

(75) Inventors: Lucas John Stoia, Taylors, SC (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 13/294,247

(22) Filed: Nov. 11, 2011

(65) Prior Publication Data

US 2013/0122434 A1 May 16, 2013

(51) Int. Cl.
*F23N 1/00* (2006.01)
*F23R 3/28* (2006.01)

(52) U.S. Cl.
CPC ..... *F23R 3/286* (2013.01); *F23R 3/283* (2013.01)
USPC ..... 431/12; 431/144

(58) Field of Classification Search
CPC ..... F23R 3/32; F23R 3/283; F23R 3/286; Y02E 20/16
USPC ..... 431/12, 195; 60/737, 772, 773
See application file for complete search history.

(56) References Cited

U.S. PATENT DOCUMENTS

| | | | | |
|---|---|---|---|---|
| 3,771,500 | A | | 11/1973 | Shakiba |
| 4,104,873 | A | | 8/1978 | Coffinberry |
| 4,412,414 | A | | 11/1983 | Novick et al. |
| 5,104,310 | A | | 4/1992 | Saltin |
| 5,205,120 | A | | 4/1993 | Obländer et al. |
| 5,213,494 | A | | 5/1993 | Jeppesen |
| 5,341,645 | A | | 8/1994 | Ansart et al. |
| 5,439,532 | A | | 8/1995 | Fraas |
| 5,461,864 | A | * | 10/1995 | Betta et al. ..... 60/723 |
| 5,515,680 | A | * | 5/1996 | Fujimura et al. ..... 60/737 |
| 5,592,819 | A | | 1/1997 | Ansart et al. |
| 5,707,591 | A | | 1/1998 | Semedard et al. |
| 6,098,407 | A | | 8/2000 | Korzendorfer et al. |
| 6,123,542 | A | | 9/2000 | Joshi et al. |
| 6,171,353 | B1 | * | 1/2001 | Park et al. ..... 55/282.2 |
| 6,394,791 | B2 | | 5/2002 | Smith et al. |
| 6,438,961 | B2 | | 8/2002 | Tuthill et al. |
| 6,598,383 | B1 | * | 7/2003 | Vandervort et al. ..... 60/773 |
| 6,796,790 | B2 | | 9/2004 | Venizelos et al. |
| 6,983,600 | B1 | | 1/2006 | Dinu et al. |
| 7,003,958 | B2 | | 2/2006 | Dinu et al. |
| 7,007,478 | B2 | | 3/2006 | Dinu |
| 7,469,544 | B2 | * | 12/2008 | Farhangi ..... 60/740 |
| 7,631,499 | B2 | | 12/2009 | Bland |
| 7,752,850 | B2 | | 7/2010 | Laster et al. |
| 2003/0110774 | A1 | * | 6/2003 | Saitoh ..... 60/737 |
| 2004/0216463 | A1 | | 11/2004 | Harris |

(Continued)

*Primary Examiner* — Steven B McAllister
*Assistant Examiner* — Steven Anderson, II
(74) *Attorney, Agent, or Firm* — Dority & Manning, PA

(57) ABSTRACT

A combustor includes an end cap, a combustion chamber downstream from the end cap, and a plurality of tubes that extends through the end cap to provide fluid communication through the end cap to the combustion chamber. A casing surrounds the end cap, and a conduit extends from the casing to the end cap. A duct extends around the conduit and inside the end cap to provide fluid communication to the end cap. A method for supplying fuel to a combustor includes flowing a working fluid through a plurality of tubes that extends axially through an end cap, supplying a first fluid through a conduit into the end cap, and supplying a second fluid through a duct spiraling around the conduit into the end cap.

8 Claims, 3 Drawing Sheets

(56) References Cited

U.S. PATENT DOCUMENTS

| | | | | |
|---|---|---|---|---|
| 2008/0016876 | A1 | 1/2008 | Colibaba-Evulet et al. | |
| 2008/0166672 | A1* | 7/2008 | Schlote et al. | 431/9 |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0101229 | A1* | 4/2010 | York et al. | 60/737 |
| 2010/0139280 | A1 | 6/2010 | Lacey et al. | |
| 2010/0186413 | A1 | 7/2010 | Lacey et al. | |
| 2010/0192579 | A1* | 8/2010 | Boardman et al. | 60/737 |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1* | 1/2011 | Kraemer et al. | 60/772 |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |

* cited by examiner

COMBUSTOR AND METHOD FOR SUPPLYING FUEL TO A COMBUSTOR

FIELD OF THE INVENTION

The present invention generally involves a combustor and a method for supplying fuel to the combustor.

BACKGROUND OF THE INVENTION

Combustors are commonly used in industrial and power generation operations to ignite fuel to produce combustion gases having a high temperature and pressure. Various competing considerations influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of tubes may be radially arranged in an end cap to provide fluid communication for a working fluid to flow through the end cap and into a combustion chamber. A fuel may be supplied to a plenum inside the end cap to flow over the outside of the tubes to provide convective cooling to the tubes before flowing into the tubes to mix with the working fluid. The enhanced mixing between the fuel and working fluid in the tubes allows leaner combustion at higher operating temperatures while protecting against flashback or flame holding and controlling undesirable emissions. However, the convective cooling provided by the fuel before entering the tubes may result in uneven heating of the fuel. As a result, temperature and density variations in the fuel flowing through the tubes may produce thermal stress in the tubes and/or uneven fuel-working fluid ratios that adversely affect flame stability, combustor performance, and/or undesirable emissions. Therefore, an improved combustor and method for supplying fuel to the combustor that reduces thermal stress in the tubes and/or temperature and density variations in the fuel flowing through the tubes would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap configured to extend radially across at least a portion of the combustor, wherein the end cap includes an upstream surface axially separated from a downstream surface. A cap shield circumferentially surrounds at least a portion of the upstream and downstream surfaces, and a plurality of tubes extends from the upstream surface through the downstream surface to provide fluid communication through the end cap. A plenum is inside the end cap between the upstream and downstream surfaces. A conduit extends inside the plenum, and a duct extends around the conduit and inside the plenum to provide fluid communication to the plenum.

Another embodiment of the present invention is a combustor that includes an end cap configured to extend radially across at least a portion of the combustor, a combustion chamber downstream from the end cap, and a plurality of tubes that extends through the end cap to provide fluid communication through the end cap to the combustion chamber. A casing surrounds the end cap, and a conduit extends from the casing to the end cap to provide fluid communication to the end cap. A duct that spirals around the conduit extends inside the end cap to provide fluid communication to the end cap.

Embodiments of the present invention may also include a method for supplying fuel to a combustor that includes flowing a working fluid through a plurality of tubes that extends axially through an end cap, supplying a first fluid through a conduit into the end cap, and supplying a second fluid through a duct spiraling around the conduit into the end cap.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
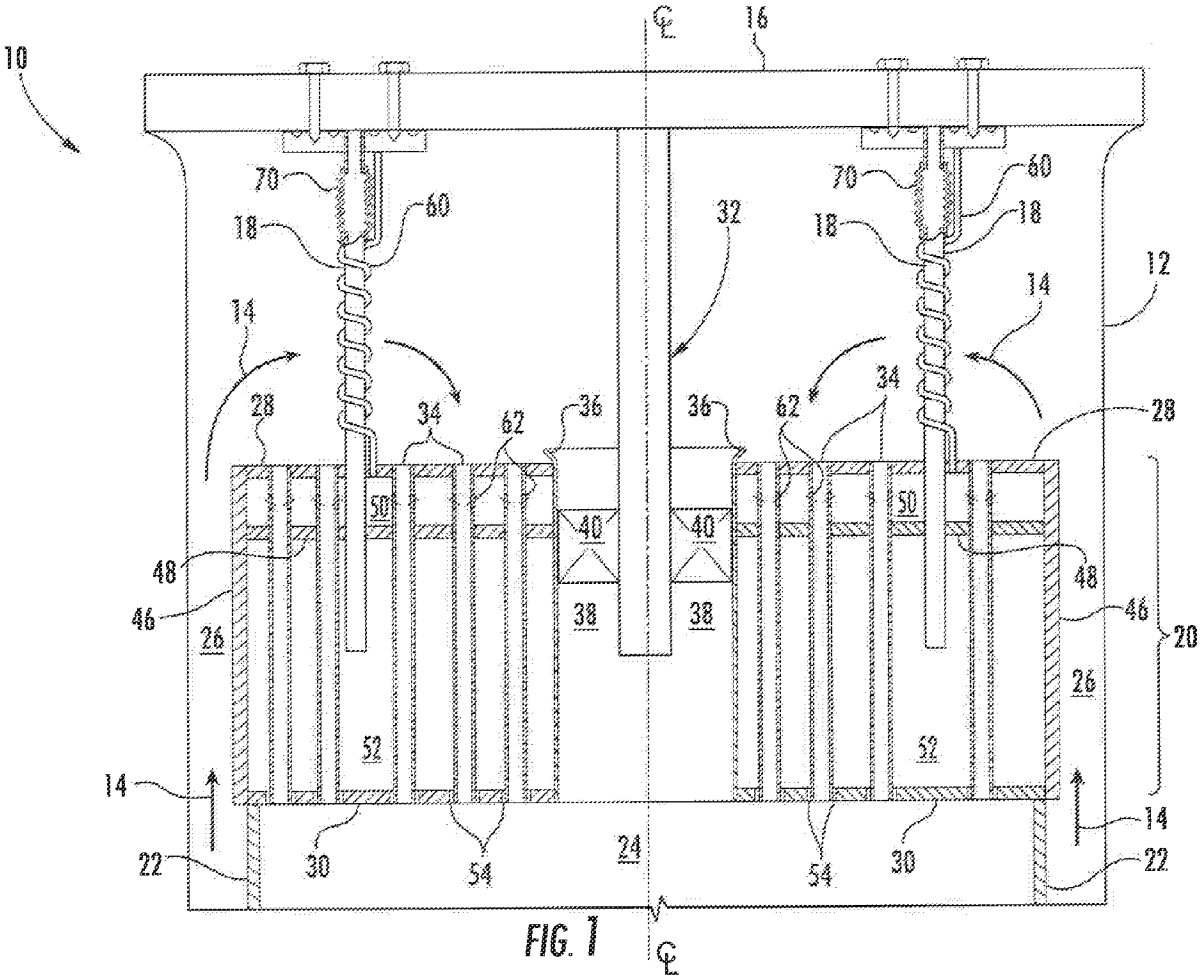
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for supplying fuel to the combustor. The combustor generally includes a casing that encloses a working fluid flowing though the combustor. A plurality of tubes radially arranged in an end cap enhances mixing between the working fluid and a fuel prior to combustion. In particular embodiments, one or more conduits may extend between the casing and end cap to supply a fuel, diluent, and/or other additive to the end cap. A duct may extend outside of the conduit to evenly heat fuel flowing through the duct before the fuel flows into the tubes to mix with the working fluid. In particular embodiments, the duct may spiral around the conduit. The improved heating of the fuel reduces the thermal stress across the tubes and/or the temperature and density variations in the fuel flowing through the tubes to enhance flame stability, combustor performance, and/or undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
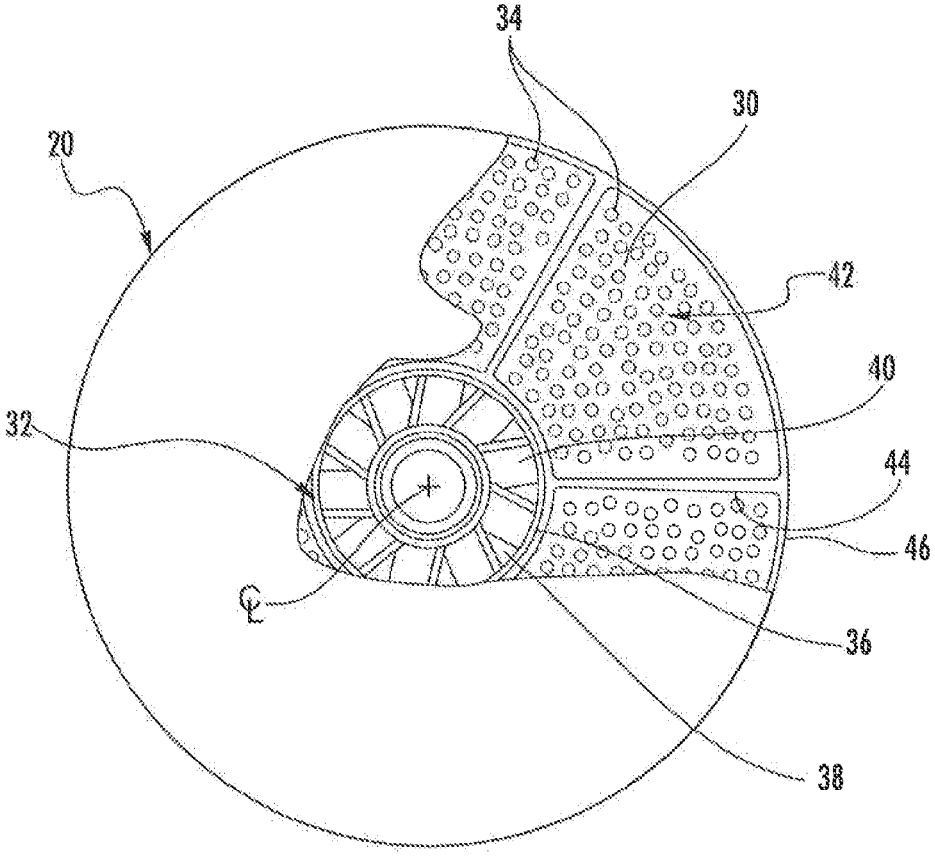
FIG. 2 is an upstream axial view of the combustor shown in FIG. 1 according to an embodiment of the present invention.

FIG. 1 provides a simplified cross-section view of an exemplary combustor 10 according to one embodiment of the present invention, and FIG. 2 provides an upstream axial view of the combustor 10 shown in FIG. 1. As shown, a casing 12 generally surrounds the combustor 10 to contain a working fluid 14 flowing to the combustor 10. The casing 12 may include an end cover 16 at one end that provides an interface for supplying fuel, diluent, and/or other additives to the combustor 10. One or more fluid conduits 18 may extend axially from the end cover 16 to an end cap 20 to provide fluid communication for the fuel, diluent, and/or other additives to the end cap 20. The end cap 20 generally extends radially across at least a portion of the combustor 10, and the end cap 20 and a liner 22 generally define a combustion chamber 24 downstream from the end cap 20. The casing 12 circumferentially surrounds the end cap 20 and/or the liner 22 to define an annular passage 26 that surrounds the end cap 20 and liner 22. In this manner, the working fluid 14 may flow through the annular passage 26 along the outside of the liner 22 to provide convective cooling to the liner 22. When the working fluid 14 reaches the end cover 16, the working fluid 14 may reverse direction to flow through the end cap 20 and into the combustion chamber 24.

The end cap 20 generally includes an upstream surface 28 axially separated from a downstream surface 30, and one or more nozzles 32 and/or tubes 34 may extend from the upstream surface 28 through the downstream surface 30 to provide fluid communication through the end cap 20 to the combustion chamber 24. The particular shape, size, number, and arrangement of the nozzles 32 and tubes 34 may vary according to particular embodiments. For example, the nozzles 32 and tubes 34 are generally illustrated as having a cylindrical shape; however, alternate embodiments within the scope of the present invention may include nozzles and tubes having virtually any geometric cross-section.

The nozzle 32 may extend axially from the end cover 16 through the end cap 20. A shroud 36 may circumferentially surround the nozzle 32 to define an annular passage 38 around the nozzle 32 and provide fluid communication through the end cap 20. The working fluid 14 may thus flow through the annular passage 38 and into the combustion chamber 24. In addition, the nozzle 32 may supply fuel, diluent, and/or other additives to the annular passage 38 to mix with the working fluid 14 before entering the combustion chamber 24. One or more vanes 40 may extend radially between the nozzle 32 and the shroud 36 to impart swirl to the fluids flowing through the annular passage 38 to enhance mixing of the fluids before reaching the combustion chamber 24.

The tubes 34 may be radially arranged across the end cap 20 in one or more tube bundles 42 of various shapes and sizes, with each tube bundle 42 in fluid communication with one or more fluid conduits 18. For example, as shown in FIG. 2, one or more dividers 44 may extend axially between the upstream and downstream surfaces 28, 30 to separate or group the tubes 34 into pie-shaped tube bundles 42 radially arranged around the nozzle 32. One or more fluid conduits 18 may provide one or more fuels, diluents, and/or other additives to each tube bundle 42, and the type, fuel content, and reactivity of the fuel and/or diluent may vary for each fluid conduit 18 or tube bundle 42. In this manner, different types, flow rates, and/or additives may be supplied to one or more tube bundles 42 to allow staged fueling of the tubes 34 over a wide range of operating conditions.

A cap shield 46 may circumferentially surround at least a portion of the upstream and downstream surfaces 28, 30 to at least partially define one or more plenums inside the end cap 20 between the upstream and downstream surfaces 28, 30. For example, as shown most clearly in FIG. 1, a barrier 48 may extend radially inside the end cap 20 between the upstream and downstream surfaces 28, 30 to at least partially define a fuel plenum 50 and a diluent plenum 52 inside the end cap 20. Specifically, the upstream surface 28, cap shield 46, and barrier 48 may define the fuel plenum 50, and the downstream surface 30, cap shield 46, and barrier 48 may define the diluent plenum 52.

In the particular embodiment shown in FIG. 1, the fluid conduits 18 extend inside the end cap 20 to provide fluid communication to the diluent plenum 52. In this manner, the fluid conduits 18 may supply a diluent or other additive to the diluent plenum 52. Possible diluents supplied through the fluid conduits 18 may include, for example, water, steam, air, fuel additives, inert gases such as nitrogen, and/or non-flammable gases such as carbon dioxide or combustion exhaust gases supplied to the combustor 10. The diluent may flow around the tubes 34 in the diluent plenum 52 to provide convective cooling to the tubes 34 before flowing through one or more diluent passages 54 between the tubes 34 and the downstream surface 30 and into the combustion chamber 24.

As further shown in FIG. 1, the combustor 10 may further include a duct 60 that extends around each fluid conduit 18 and inside the end cap 20 to provide fluid communication to the fuel plenum 50. The duct 60 may include multiple lengths outside of the fluid conduit 18 between the end cover 16 and the end cap 20 to increase the surface area of the duct 60 exposed to the working fluid 14 flowing around and past the fluid conduit 18. Alternately, or in addition, as shown in FIG. 1, the duct 60 may spiral around the outside of the fluid conduit 18 to increase the surface area of the duct 60 exposed to the working fluid 14 flowing around and past the fluid conduit 18. In this manner, the duct 60 may supply fuel to the fuel plenum 50, and the working fluid 14 flowing around and past the duct 60 may heat the fuel in the duct 60 before the fuel reaches the fuel plenum 50. Depending on various parameters, such as the length, thickness, and diameter of the duct 60, the working fluid 14 may heat the fuel to within 30 degrees, 20 degrees, or even 5 degrees Fahrenheit of the working fluid 14 temperature. The heated fuel may flow inside the fuel plenum 50 and through one or more fuel ports 62 in one or more of the tubes 34. The fuel ports 62 provide fluid communication from the fuel plenum 50 into the tubes 34 and may be angled radially, axially, and/or azimuthally to project and/or impart swirl to the fuel flowing through the fuel ports 62 and into the tubes 34. The fuel may then mix with the working fluid 14 flowing through the tubes 34 before entering the combustion chamber 24.

The temperature of the fuel and working fluid 14 flowing around and through the combustor 10 may vary considerably during operations, causing the casing 12, fluid conduits 18, and/or tubes 34 to expand or contract at different rates and by different amounts. As a result, a flexible coupling 70 may be included in one or more fluid conduits 18 between the end cover 16 and the end cap 20. The flexible coupling 70 may include one or more expansion joints or bellows that accommodate axial displacement by the casing 12, fluid conduits 18, and/or tubes 34 caused by thermal expansion or contraction. One of ordinary skill in the art will readily appreciate that alternate locations and/or combinations of flexible couplings 70 are within the scope of various embodiments of the present invention, and the specific location or number of flexible couplings 70 is not a limitation of the present invention unless specifically recited in the claims.

Figure 3:
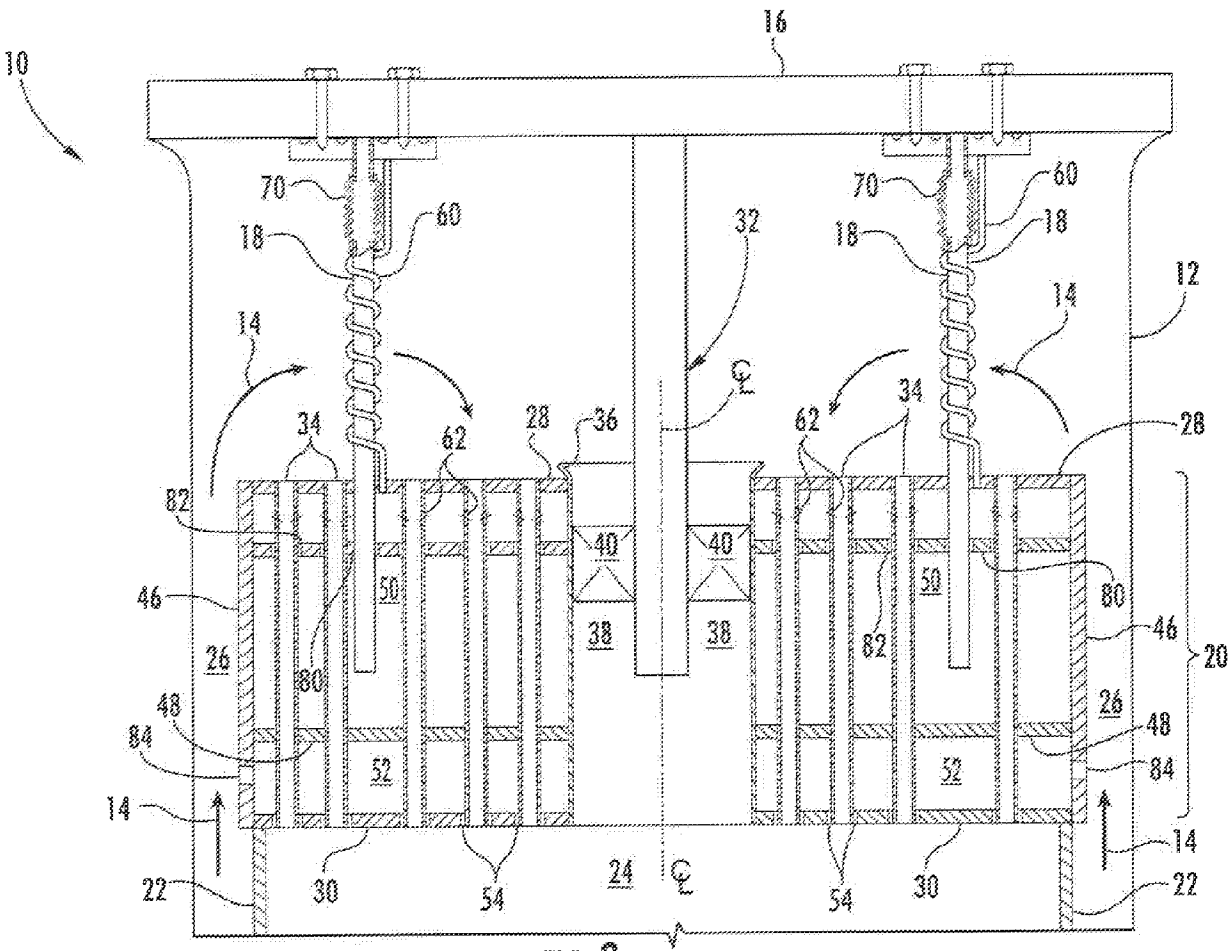
FIG. 3 is a simplified cross-section view of an exemplary combustor according to an alternate embodiment of the present invention.

FIG. 3 provides a simplified cross-section view of an exemplary combustor 10 according to an alternate embodiment of the present invention. The combustor 10 again includes the casing 12, end cap 20, combustion chamber 24, nozzle 32, tubes 34, cap shield 46, barrier 48, fuel and diluent plenums 50, 52, diluent passages 54, ducts 60, and fuel ports 62 as previously described with respect to the embodiment shown in FIGS. 1 and 2. In this particular embodiment, however, the fluid conduits 18 extend inside the end cap 20 to provide fluid communication to the fuel plenum 50, and a baffle 80 extends radially inside the fuel plenum 50 between the upstream surface 28 and the barrier 48. A plurality of passages 82 extends through the baffle 80 to provide fluid flow axially across the baffle 80. The passages 82 may include, for example, gaps between the baffle 80 and the tubes 34 or holes that extend axially through the baffle 80. In this manner, the fluid conduits 18 and ducts 60 may both supply fuel to the fuel plenum 50. The fuel supplied by the fluid conduits 18 may flow around the tubes 34 in the fuel plenum 50 to provide convective cooling to the tubes 34 before flowing through the plurality of passages 82 in the baffle 80 toward the upstream surface 28. The fuel supplied by the fluid conduits 18 may then mix with the fuel supplied by the ducts 60 before flowing into the tubes 34 through the fuel ports 62.

As shown in FIG. 3, one or more diluent ports 84 may extend through the cap shield 46 to provide fluid communication through the cap shield 46 and into the diluent plenum 52. At least a portion of the working fluid 14 may thus flow through the diluent ports 84 and into the diluent plenum 52. The working fluid 14 may flow around the tubes 34 in the diluent plenum 52 to provide convective cooling to the tubes 34 before flowing through one or more diluent passages 54 between the tubes 34 and the downstream surface 30 and into the combustion chamber 24.

The various embodiments shown and described with respect to FIGS. 1-3 may also provide a method for supplying fuel to the combustor 10. The method may include flowing the working fluid 14 through the tubes 34, supplying a first fluid through the conduit 18 into the end cap 20, and supplying a second fluid through the duct spiraling around the conduit 18 into the end cap 20. In particular embodiments, the method may include supplying the first fluid to either the fuel or diluent plenums 50, 52 inside the end cap 20. Alternately or in addition, the method may include separating the first fluid from the second fluid inside the end cap 20, mixing the first fluid with the second fluid inside the end cap 20, and/or radially distributing the first fluid inside the end cap 20.

The various embodiments shown and described with respect to FIGS. 1-3 provide one or more commercial and/or technical advantages over previous combustors. For example, the ducts 60 that spiral around the fluid conduits 18 enable the working fluid 14 to evenly heat the fuel flowing through the ducts before the fuel reaches the fuel plenum 50. The improved heating of the fuel reduces thermal stresses in the tubes 34 and/or temperature and density variations in the fuel flowing through the tubes 34 to enhance flame stability, combustor performance, and/or undesirable emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

an end cover coupled to one end of a casing, the casing at least partially surrounding the combustor housing;

an end cap assembly that extends radially and circumferentially within the casing with respect to an axial centerline of the combustor, the end cap assembly including an upstream plate, a downstream plate, a circumferentially extending cap shield that extends axially therebetween, a fuel plenum defined within the end cap assembly and a tube bundle, the tube bundle comprising a plurality of tubes that provide for fluid communication through the upstream surface, the fuel plenum and the downstream surface;

a first fuel conduit that extends from the end cover and through the fuel plenum of the end cap; and a fuel duct external to the conduit that spirals around and makes contact with the conduit for heat exchange, the conduit between the end cover and the upstream surface, wherein the duct extends through the upstream surface and provides for fluid communication between the end cover and the fuel plenum; and a barrier that extends radially inside the end cap assembly with respect to an axial centerline of the end cap assembly to at least partially define the fuel plenum, wherein the barrier axially separates the fuel plenum from a diluent plenum, where the fuel plenum is upstream of the diluent plenum, defined inside the end cap assembly with respect to the axial centerline of the combustor, wherein the conduit extends inside the diluent plenum to provide fluid communication to the diluent plenum.

2. The combustor as in claim 1, further comprising one or more fuel ports through the plurality of tubes, wherein the one or more fuel ports provide fluid communication from the fuel plenum into the plurality of tubes.

3. The combustor as in claim 1, wherein the end cap assembly includes a plurality of tube bundles, the end cap assembly further comprising a divider that extends axially through the end cap assembly with respect to an axial centerline of the end cap assembly to separate adjacent tube bundles of the plurality of tube bundles.

4. The combustor as in claim 1, further comprising a fuel nozzle that extends from the end cover axially into the end cap assembly with respect to the axial centerline of the end cap assembly.

5. A method for supplying fuel to a combustor, comprising:

Providing a combustor, the combustor having:

an end cover coupled to one end of a casing, the casing at least partially surrounding the combustor housing;

an end cap assembly that extends radially and circumferentially within the casing with respect to an axial centerline of the combustor, the end cap assembly including an upstream plate, a downstream plate, a circumferentially extending cap shield that extends axially therebetween, a fuel plenum defined within the end cap assembly and a tube bundle, the tube bundle comprising a plurality of tubes that provide for fluid communication through the upstream surface, the fuel plenum and the downstream surface;

a first fuel conduit that extends from the end cover and through the fuel plenum of the end cap; and a fuel duct external to the conduit that spirals around and makes contact with the conduit for heat exchange, the conduit between the end cover and the upstream surface, wherein the duct extends through the upstream surface and provides for fluid communication between the end cover and the fuel plenum; and a barrier that extends radially inside the end cap assembly with respect to an axial centerline of the end cap assembly to at least partially define the fuel plenum, wherein the barrier axially separates the fuel plenum from a diluent plenum, where the fuel plenum is upstream of the diluent plenum, defined inside the end cap assembly with respect to the axial centerline of the combustor, wherein the conduit extends inside the diluent plenum to provide fluid communication to the diluent plenum, and flowing a working fluid through a plurality of tubes that extends axially through the end cap assembly, and supplying a fuel into the fuel plenum defined within the end cap assembly via the fuel duct that spirals around an outer surface of the conduit.

6. The method as in claim 5, further comprising supplying a fluid to a diluent plenum defined inside the end cap assembly.

7. The method as in claim 6, further comprising separating the fluid from the fuel inside the end cap assembly.

8. The method as in claim 5, further comprising mixing a fluid with the fuel inside the end cap assembly.

* * * * *